US005285683A

United States Patent [19]

Abass et al.

[11] Patent Number: 5,285,683

[45] Date of Patent: Feb. 15, 1994

[54] METHOD AND APPARATUS FOR DETERMINING ORIENTATION OF A WELLBORE RELATIVE TO FORMATION STRESS FIELDS

[75] Inventors: Hazim H. Abass, Duncan; Saeed Hedayati, Lawton; James J. Venditto, Duncan, all of Okla.

[73] Assignee: Halliburton Company, Duncan, Okla.

[21] Appl. No.: 955,110

[22] Filed: Oct. 1, 1992

[51] Int. Cl.[5] ..... E21B 47/00

[52] U.S. Cl. ..... 73/155; 166/308

[58] Field of Search ..... 73/151, 155; 166/250, 166/308, 271, 245

[56] References Cited

U.S. PATENT DOCUMENTS 4,005,750 2/1977 Shuck ..... 166/308
4,724,905 2/1988 Uhri ..... 166/250
4,830,106 5/1989 Uhri ..... 166/250
5,005,643 4/1991 Soliman et al. ..... 166/250

*Primary Examiner*—Robert J. Warden
*Assistant Examiner*—Hien Tran
*Attorney, Agent, or Firm*—Arnold, White & Durkee

[57] ABSTRACT

The invention provides a method for determining the orientation of a wellbore relative to stress fields within a formation through analysis of pressure climb data during a test fracturing operation. The test fracturing operation may be formed in a plurality of wells having a known angular relation to one another in a given formation. A known angular or azimuthal relationship between the wells may be correlated with the derivative of the pressure decline proximate the relief in pressure area to define maximum azimuthal stress field and a minimum azimuthal stress field in the formation.

5 Claims, 5 Drawing Sheets

METHOD AND APPARATUS FOR DETERMINING ORIENTATION OF A WELLBORE RELATIVE TO FORMATION STRESS FIELDS

BACKGROUND OF INVENTION

The present invention relates generally to the determination of fracture orientation relative to a wellbore and relative to formation stress fields, and more specifically relates to such methods performed in response to analysis of pressures observed during a fracturing operation.

The use of test fracturing operations to determine reservoir or formation characteristics prior to the performance of a full scale fracturing operation is well-known. For example, the evaluation of a formation through use of a test fracturing operation performed through use of a fracturing fluid without proppant is well-known. Exemplary procedures of this type are those normally referred to in the industry as "minifrac" or "microfrac" operations.

As an example of a microfrac operation, during the microfrac operation a short interval of a wellbore is pressurized until a "breakdown" of the formation occurs. The formation will breakdown when the pressure at the formation reaches a "breakdown pressure," i.e., that pressure at which the tangential stress changes from compression into tension and reaches the tensile strength of the formation. At this point, the formation will yield to the stress, and a tensile fracture will be created. As pressure is monitored during the pressurization of the wellbore interval approaching the breakdown pressure, the characteristics of the monitored pressure curve will depend upon the fluid injection rate and the fluid leak-off rate. As pressure continues to be applied, the fracture will extend, and the extension pressure may either increase or decrease, depending upon any height restriction on fracture propagation and fluid leak-off. At some point, the injection will be ceased, and an instantaneous shut-in pressure will be recorded. As is known to the industry, this parameter will yield information regarding frictional pressure during the injection operation. Pressure decline after shut-in will be monitored, and the closure pressure will be determined. The closure pressure is that pressure at which the created fracture will close. This pressure will be equivalent to the minimum horizontal stress within the formation. If the shut-in is continued for an extended period, the formation will eventually reach an equilibrium pressure, at which time the pressure will be equal to the initial reservoir pressure.

Conventional minifrac and microfrac pressure analysis operations have not been capable of providing an indication of the direction of the fracture from the wellbore relative to stress fields existing in the formation. This information is highly desirable, as it will provide information useful, for example, in the design of future perforating operations and the design of full scale fracturing treatments for the wellbore. Additionally, the determination of a direction of fracture propagation, particularly in highly deviated or generally horizontal wells, may be particularly useful.

Accordingly, the present invention provides a new method and apparatus for utilizing observed pressure data during a test fracturing operation to determine the fracture direction relative to stress fields in the formation surrounding the wellbore. The method and apparatus of the present invention may also be particularly useful in deviated or horizontal wells to determine the direction of the fracture relative to the wellbore direction.

SUMMARY OF THE INVENTION

The present invention provides a method of determining the azimuthal direction of a deviated borehole relative to stress fields within a formation. In a currently envisioned preferred embodiment, the deviated borehole will preferably be one of at least three boreholes which extend in a known angular relation to one another at least proximate a portion of their extent within a formation. This type of data may typically be obtained through use of conventional well surveys.

In a preferred method of practicing the invention, fluid pressure will be individually applied in each of the boreholes proximate a selected formation to establish a breakdown pressure in the formation so as to establish a fracture in the formation and a relief in pressure after the breakdown pressure is reached. As with conventional test fracturing operations, the pressure will be monitored, at least during the time that the breakdown pressure is achieved and a time at which the relief in pressure occurs. Once the relief in pressure data is obtained for each of the three wells, the derivative of the relief in pressure will be determined for each of the three wells. The derivative of the relief in pressure for each of the three wells will be functionally related, such as through use of a graphical plot, relative to the known angular relation between the wells proximate the formation under examination. The derivatives of the relief in pressure for the three wells will define coordinates which are indicative of the actual angular deviation of one or more of the wells relative to the minimal and maximal stress fields within the formation. This information will also be indicative of the actual direction of fracture propagation. Accordingly, the direction of the stress fields and fracture propagation relative to the known well azimuth in a particular formation will also provide data representative of the fracture azimuth within the formation.

DETAILED DESCRIPTION OF PREFERRED EMBODIMENTS

Figure 1:
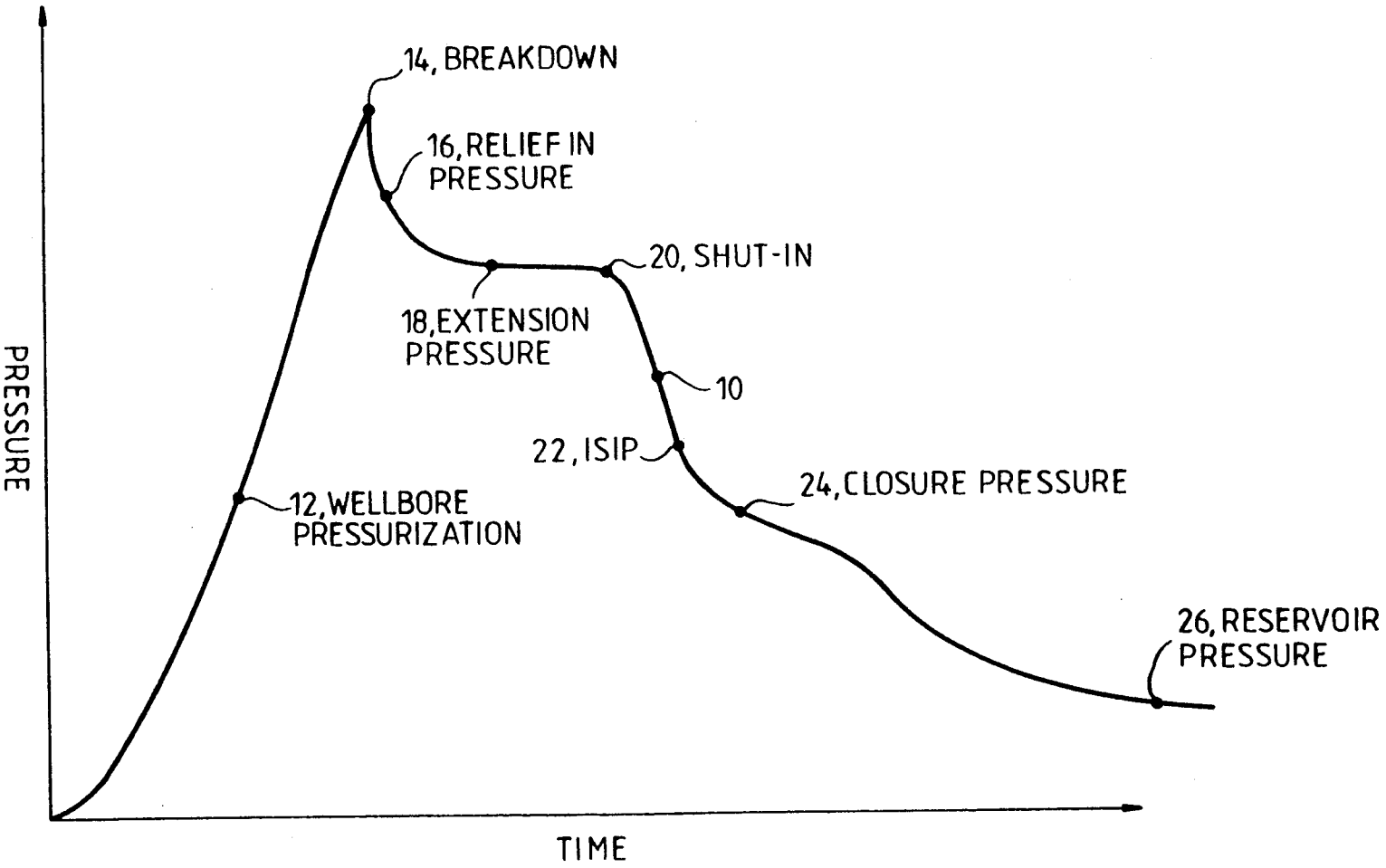
FIG. 1 graphically represents pressures observed during a conventional test fracturing operation.

Referring now to the drawings in more detail, and particularly to FIG. 1, therein is depicted an exemplary curve 10 of pressure behavior during a typical microfrac test fracturing procedure. During the procedure, pressure will be applied in the wellbore 12 during the microfrac. As can be seen from curve 10, pressure will be applied until the time 14 when the breakdown pressure is achieved and a fracture is opened. Following the breakdown pressure 14, there is a relief in pressure 16 representing an abrupt drop in pressure after the breakdown pressure. Following the relief in pressure on curve 10, is the pressure decline from breakdown pressure to the extension pressure 18 for the formation. In an open hole wellbore, without substantial permeability damage, the breakdown pressure will reflect the in situ stress field around the wellbore, while the extension pressure will be controlled primarily by the minimum horizontal stress in the stress field. When the well is shut-in 20, there will be another abrupt pressure decline yielding the instantaneous shut-in pressure 22 followed by a period of relatively gradual pressure decline until a closure pressure has reached 24. After closure, fluid will gradually leak-off into the formation over time until the monitored pressure will be equal to the initial reservoir pressure 26.

The inventors have discovered that the profile of the pressure curve proximate the relief in pressure 16 after breakdown is functionally related to fracture direction relative to stress fields in the formation surrounding a wellbore.

Figure 2:
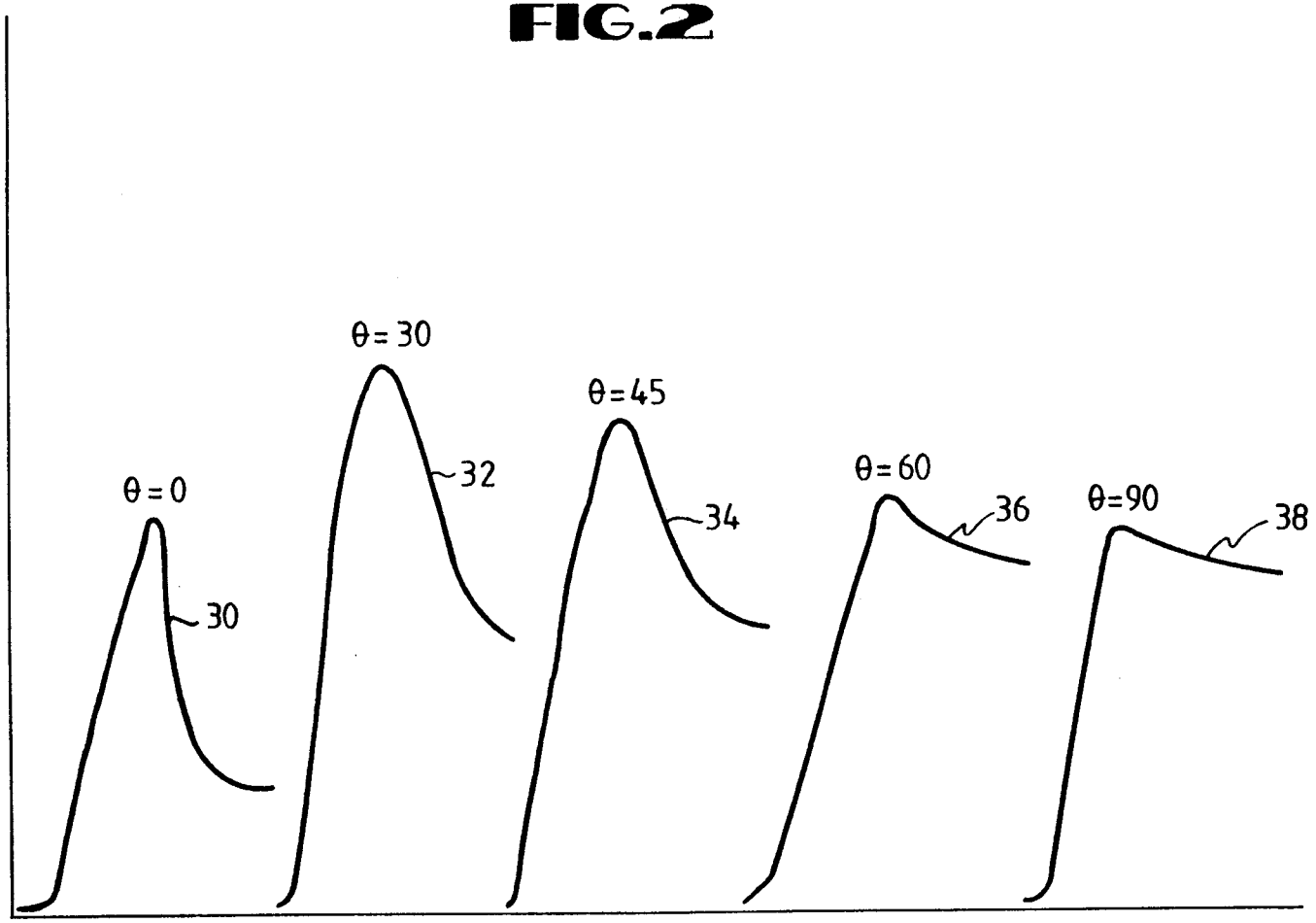
FIG. 2 graphically depicts a representation representative of a test procedure wherein the profile of the relief and pressure curve was observed for different orientations of wellbores within a fractured simulated formation.

FIG. 2 depicts exemplary curves determined during an experimental procedure to observe pressure data in a test fixture. The test fixture involved a synthetic wellbore assembly, wherein hydrostone (gypsum cement) blocks of six by six by ten inches were utilized to simulate a formation under fracture. The blocks were cast from mixing water and hydrostone with a weight ratio of 32:100, respectively. The physical and mechanical properties of the man-made rock were as follows:

| | |
|---|---|
| Porosity = | 26.5% |
| Permeability ($N_2$) = | 3.9 md (milledarcy) |
| Grain density = | 2.23 gm/cc |
| Bulk density = | 1.171 gm/cc |
| Young's Modulus = | $2.07 \times 10^6$ psi |
| Poisson's ratio = | 0.21 |
| Uniaxial compressive strength = | 8032 psi |
| Tensile strength (Brazilian) = | 807.6 psi |

A wellbore was cast in the center of the block perpendicular to the sample axis along the 10 inch side. The wellbore was cast with different orientation angles $\theta$, relative to the minimum horizontal stress. A series of angles was considered: $\theta = 15, 30, 34, 45, 60, 67.5$, and 90 degrees. One sample with a vertical hole was fractured to provide reference data for a fractured vertical hole under triaxial loading conditions. All samples were confined in a triaxial loading vessel and the principal stresses applied were: 3,000 psi vertical, 2,500 psi maximum horizontal, and 1,400 psi minimum horizontal stresses. Axial load was applied utilizing a 120,000 pound Riehl universal loading machine. The sample was loaded in steps of 500 psi. A 500 psi axial force was applied first relative to the longest dimensions of the sample. The horizontal stresses were then raised together to 1,400 psi when vertical stress continued to 2,500 psi was held. Axial load then continued to 3,000 psi. No pore pressure was present within the sample block.

Fracturing fluid used in the tests was 30-weight motor oil was apparent viscosities of 580, 360, and 14 cp (centipoise) at 74, 83, and 195° F., respectively. All experiments were conducted at room temperature (74° to 78° F.) with injection rate of 30 $cm^3$/min. Identical rock type, rock properties, loading conditions, fracturing fluid properties, injection rate, and fracturing treatment were used throughout the course of testing. The only variable was the wellbore orientation relative to the maximum horizontal stress. Injection was accomplished at the rate of thirty cubic centimeters per minute.

Referring again to FIG. 2, therein is shown an exemplary set of relief in pressure curves with the variable being the angular deviation of the wellbore axis relative to the minimum stress field on the test sample. Each curve 30, 32, 34, 36, and 38, represents the observed pressure curves when the wellbore's orientation angle $\theta$ was 0°, 30°, 45°, 60°, and 90°, respectively, relative to, from the minimum stress field.

Figure 3:
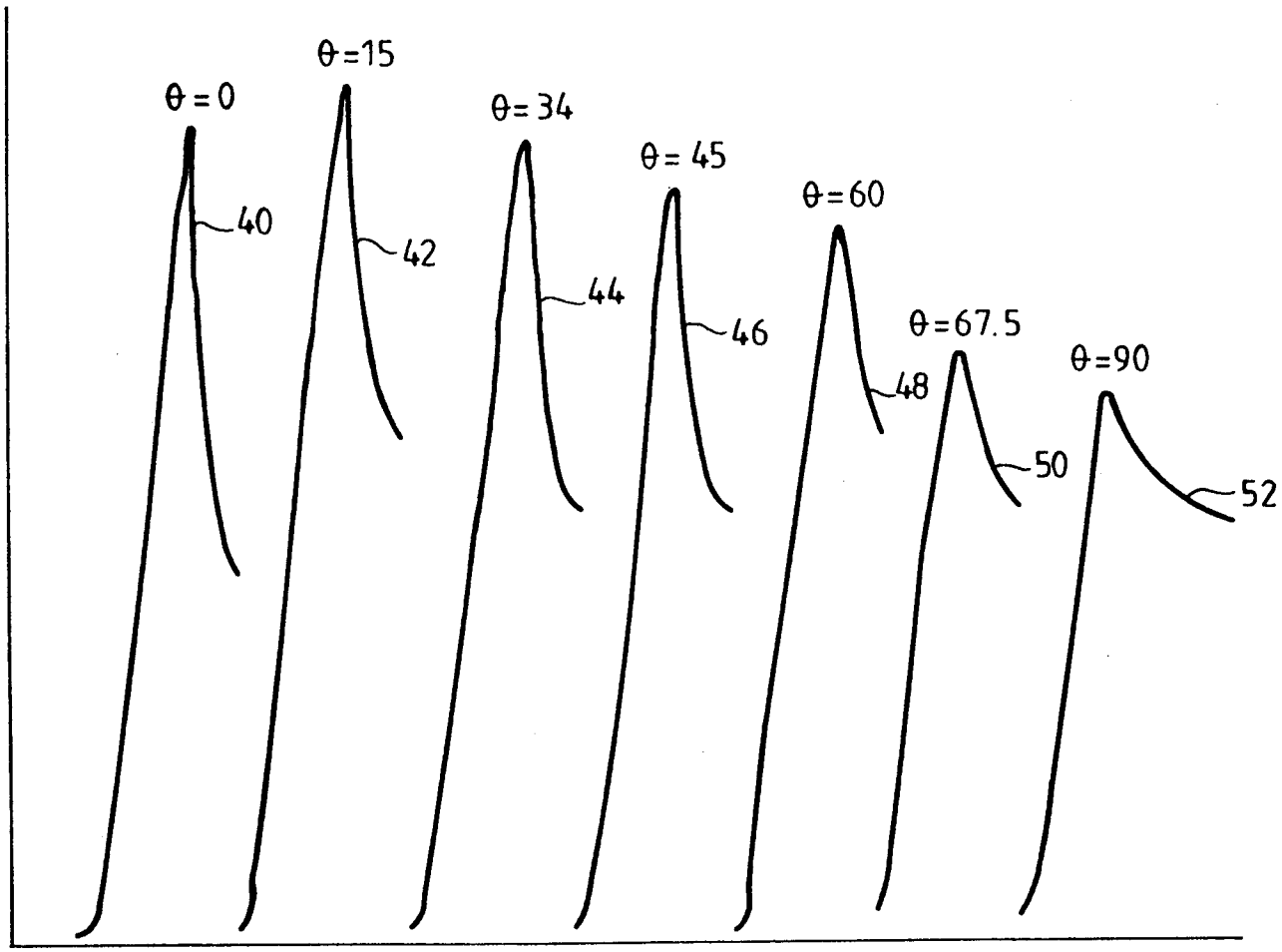
FIG. 3 graphically depicts an alternative representation representative of a test procedure wherein the profile of the relief and pressure curve was observed for different orientations of wellbores within a fractured simulated formation.

Referring now to FIG. 3, therein are depicted seven curves, 40, 42, 44, 46, 48, 50, and 52, representing deviations of the wellbore relative to the minimum horizontal stress field of 0°, 15°, 34°, 45°, 60°, 67.5°, and 90°, respectively, as were observed during a second test procedure.

The derivatives of the pressure decline after breakdown (in psi per second), for multiple wellbores within a formation will establish a generally linear relationship to the angle of deviation of the induced fractures relative to stress fields within the formation. Because of this essentially linear relationship, fracturing operations, including test fracturing operations such as microfrac operations, in a plurality of deviated boreholes through a formation may be utilized to determine the orientation of the stress fields within the formation, and to also determine the azimuth of each fracture. For example, if microfrac operations are performed in three or more wellbores, which are each deviated from vertical as they pass through a given formation, the relative angular relationship (i.e., azimuthal relation between the non-vertical paths through the formation), of which is known, the relief in pressure data may be directly plotted to utilize the previously discussed linear relationship to determine the actual orientation of each fracture relative to the minimum horizontal stress field or to the maximum horizontal stress field, within the formation. Preferably, these wellbores under examination will extend through said formation at azimuths which are preferably angularly disposed at 45° or greater relative to one another, resulting in a total span of at least 90° between the extremes. The relief in pressure 16 data will be data obtained during the time after breakdown 14 but clearly before the extension pressure 18 is reached.

Figure 4:
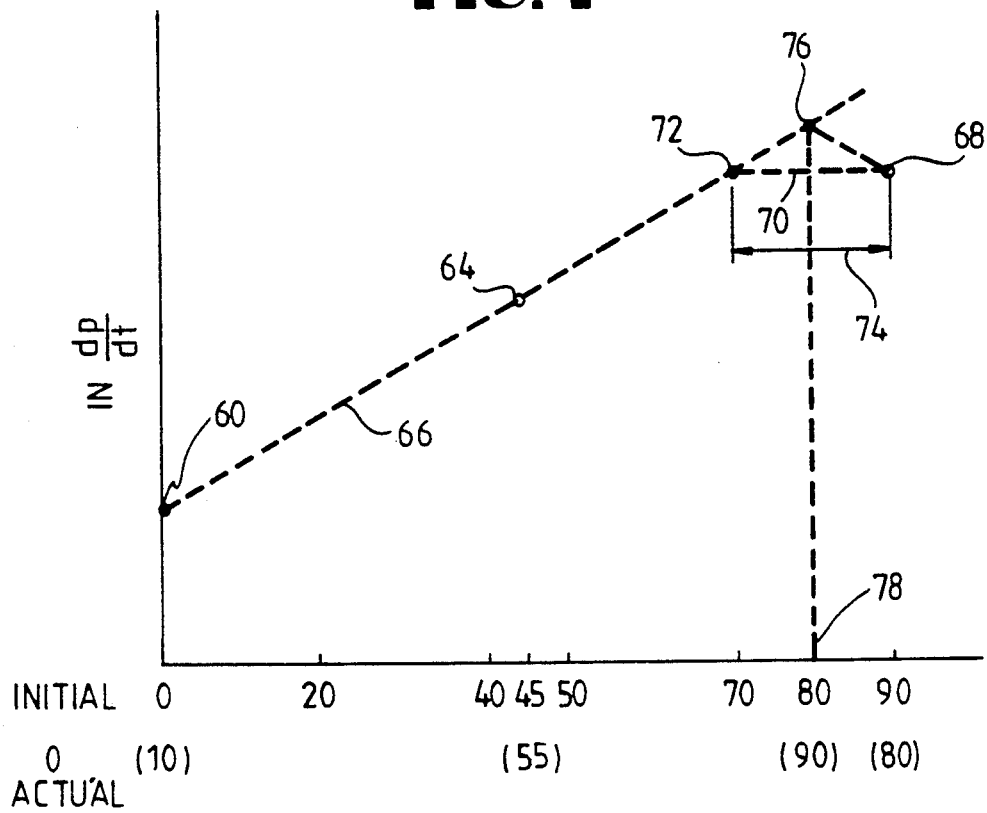
FIG. 4 graphically depicts an exemplary graphical representation of a solution for a well azimuth relative to formation stress fields in accordance with the present invention.

Referring now to FIG. 4, therein is depicted an exemplary graphical depiction of a solution of the determination of a primary wellbore relative to the maximum stress field in a formation. In this example, data points relative to three hypothetical wells, each angularly offset from one another by 45° are represented. In this example, the determined derivative of the relief in pressure for a first well 60, as described relative to FIGS. 2 and 3 with the lowest ordinate value, is plotted as the Y axis intercept deviation from the maximum stress field. The determined derivative for another well 64 will be plotted relative to the angular deviation of the well to which it pertains relative to the first well (45°) and will thereby define a line 66 determinative of the linear relationship between the determined relief in pressure relative to the maximum horizontal stress field. Another, higher derivative value 68 will then be plotted relative to its known angular deviation relative to the well from which either derivative data point 60 or 64 were derived. As can be seen in FIG. 4, point 68 lies beneath line 66. However, point 68 will facilitate in determining the offset of data points 60 and 64 relative to the actual maximum horizontal stress field. The ordinate coordinate 70 of point 68 may be utilized to find an intercept 72 with line 66. The bisecting of the offset line 74 between point 72 and point 68 will define a corrected trend line intercept 76 of which the abscissa coordinate 78 will define an angular offset relative to the deviation from the actual maximal stress field in the wellbore. For example, in the example of FIG. 4, the minimum stress field (oriented at 90° to the maximum stress field) will, in fact, be oriented at the abscissa intercept 78, which is indicative of 80° on the established abscissa scale. This then indicates that data point 60 is shifted in true angular deviation 10° relative to the maximal stress field indicating that the well from which data point 60 was obtained was in fact oriented 10° relative to the maximum stress field and that the well from which data point 64 was taken (located at a 45° angular deviation relative to the well yielding data point 60), was in fact oriented at angular deviation of 55° relative to the maximum stress field of the formation. Whereas line intercept 76 would in fact be representative of the location of the minimum stress field, it can be seen that point 68 therefore be oriented at an 80° angular deviation relative to the maximal stress field.

In evaluating the plots of the derivative values, it should be remembered that they may establish a line which is ascending, as depicted in FIG. 4, or which is descending. In all circumstances, however, plotting of the derivatives relative to the relative angular distribution to define a line through at least two points should define a line which provides a solution which both (a) defines a solution for the third point, as described relating to FIG. 4; and (b) provides such solution within the span of the total azimuthal difference between the wells from which the data was obtained (i.e., 90° in the example of FIG. 4).

Figure 5:
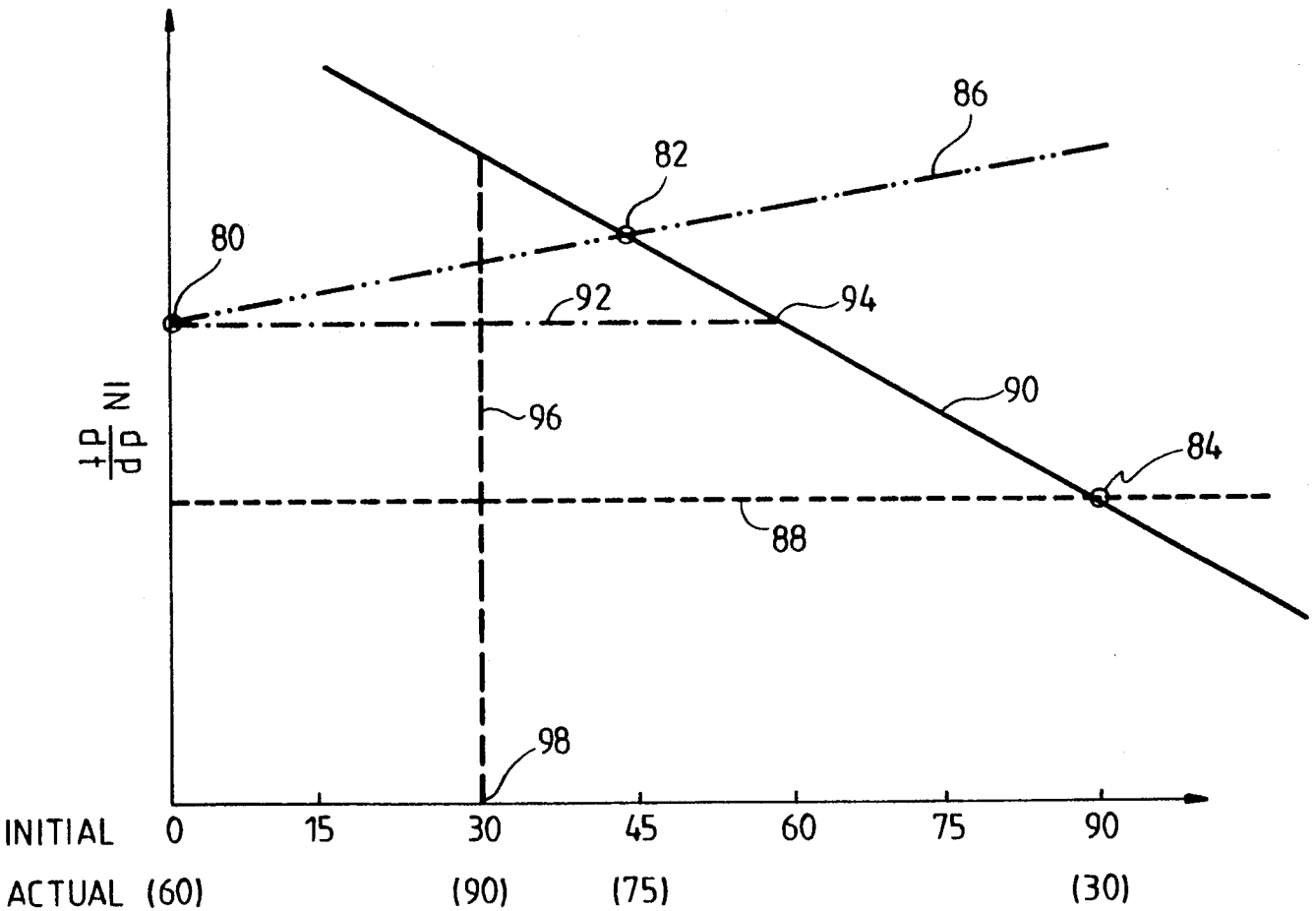
FIG. 5 graphically depicts an exemplary graphical representation of a solution for a well azimuth relative to formation stress fields in accordance with the present invention.

Referring now to FIG. 5, therein is depicted an alternative exemplary solution for another hypothetical case in which relief in pressure data is obtained from three wells oriented at 0°, 45°, and 90° relative to one another. Data point 80 relative to a first well has been plotted on the Y axis, and a data point 82 from a representative of the determined relief in pressure derivative for a second well has been plotted relative to the known angular deviation relative to the first well, and a data point 84 has been plotted relative to the further known angular deviation from the first two wells. As can be seen from dotted trend line 86 connected through data points 80 and 82, this line will not intersect within a 90° quadrant with line 88 along the Y axis intercept of data point 84. Accordingly, review of the determined data suggests that the appropriate trend line 90 will be drawn through data points 82 and 84, representing a descending trend. A line 92 extending the Y axis intercept through data point 80 will thereby intersect line 90 at point 94. Line 92 between points 80 and 94 is bisected by line 96, and the appropriate deviation from the maximal stress field is indicated by a corrected "actual" scale along the X axis. Because point 98 defines the appropriate indication of a 90° angle of deviation from the maximal stress field in the formation, Y axis can now be recognized to be 60° deviated from the maximal stress field, the point on the X axis initially assigned as 45°, will now be recognized to be 75°, and the point initially identified as 90° deviation on the X axis may now be seen to represent a 30° deviation from the maximal stress field.

Figure 6:
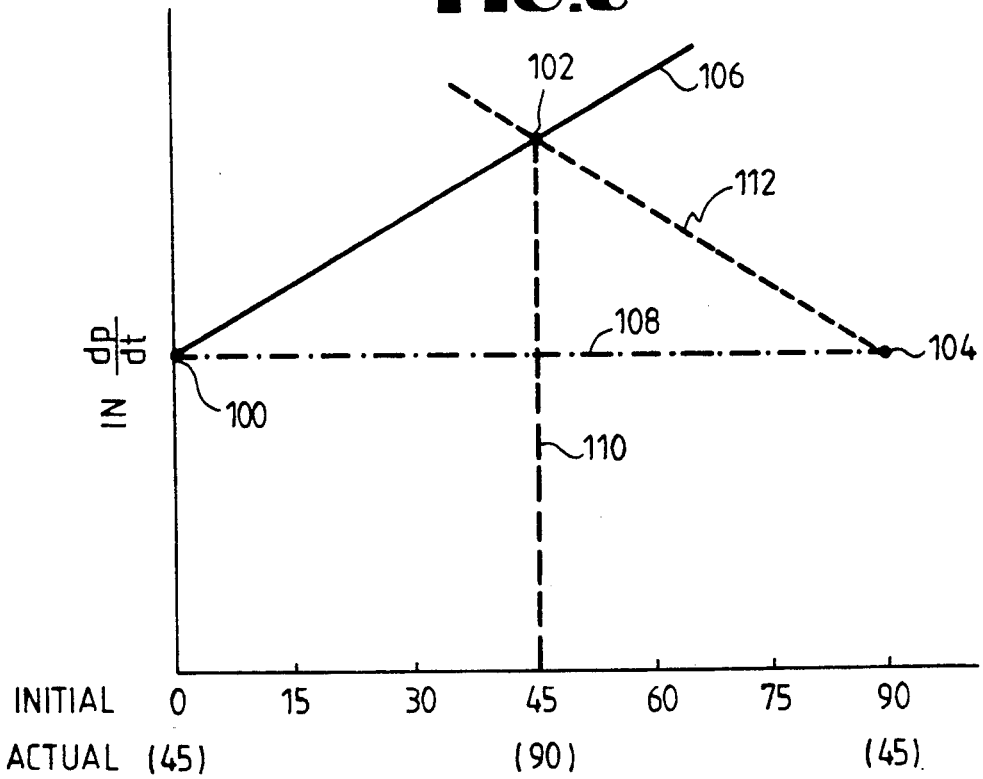
FIG. 6 graphically depicts an exemplary graphical representation of a solution for a well azimuth relative to formation stress fields in accordance with the present invention.

Referring now to FIG. 6, there is depicted another hypothetical example wherein data points 100 and 104, from three wells, again spaced known distances of 0°, 45°, and 90° relative to one another have been plotted. As can be seen in FIG. 6, points 100 and 102 have been connected by a trend line 106. The Y axis intercept line 108 of data point 104, is thus bisected by a line 110 which passes directly through point 102. Because of this relationship, these coordinates could also have been graphically analyzed through use of a trend line 112 connecting data points 102 and 104. This circumstance arises only when there exists a uniform distribution relative to the maximal stress field. Adjustment of the scale on the X axis reveals that wells 100 and 104 are each disposed at 45° relative to the maximal stress field, while the well yielding data point 102 is disposed perpendicular to the maximal stress field in the formation.

Many modifications and variations may be made in the techniques and structures described and illustrated herein without departing from the spirit and scope of the present invention. For example, although the analysis considered has been described in terms of graphical representations, it is contemplated that mathematical solutions such as might be performed through use of an appropriately programmed digital computer, might also be utilized. Accordingly, the methods and techniques described and illustrated herein should be considered to be illustrative only, and not to be limiting upon the scope of the present invention.

What is claimed is:

1. A method of determining the horizontal direction of a deviated borehole relative to stress fields within a formation, comprising the steps of:

(1) applying fluid pressure into a formation surrounding a first deviated borehole to establish a formation breakdown pressure in said formation, to establish a fracture in said formation and a relief in pressure after said formation breakdown pressure is achieved;

(2) monitoring the pressure of said formation at times including at least a time at which said formation breakdown pressure is achieved and a time at which said relief in pressure occurs;

(3) repeating said steps in two additional deviated boreholes having a known angular relation to each other and the first deviated borehole;

(4) determining a derivative of said relief in pressure for each of said three boreholes; and (5) functionally relating the determined derivative of the relief in pressure for each of said boreholes to the known angular relation between said boreholes to determine an actual angular deviation of at least one of said boreholes relative to a stress field in said formation.

2. The method of claim 1, wherein each of said boreholes extends relative to a generally common, generally vertical axis.

3. The method of claim 1, wherein each of said boreholes extends generally horizontally at a selected position with respect to the formation to which fluid pressure is being applied.

4. The method of claim 1, wherein each of said boreholes extends generally horizontally through the formation to which fluid pressure is being applied.

5. A method of determining the azimuthal direction of a deviated portion of a borehole relative to stress fields within a formation, comprising the steps of:

(1) fracturing a formation by injecting fluid into a first deviated borehole to establish a formation breakdown pressure in said formation, to establish a fracture in said formation, and a relief in pressure after said formation breakdown pressure is achieved;

(2) monitoring the pressure in said formation at times including at least a time at which said formation breakdown pressure is achieved, and a time at which said relief in pressure after breakdown occurs;

(3) repeating said steps 1 and 2 in two additional boreholes having a known angular relation to each other and the first deviated borehole;

(4) determining a derivative of said relief in pressure for each of said boreholes; and (5) functionally relating the determined derivative of the relief in pressure for each of said boreholes to the known angular relation between said boreholes to determine an actual angular deviation of at least one of said boreholes relative to a stress field in said formation, and to determine an azimuthal relationship of said fracture induced from a selected one of said boreholes relative to said selected borehole.

* * * * *

UNITED STATES PATENT AND TRADEMARK OFFICE

CERTIFICATE OF CORRECTION

PATENT NO. : 5,285,683

DATED : February 15, 1994

INVENTOR(S) : Abass H. Hazim, et al

It is certified that error appears in the above-indentified patent and that said Letters Patent is hereby corrected as shown below:

Column 4, line 32, after "relationship", please insert --relative--.

Signed and Sealed this

Twelfth Day of July, 1994

Bruce Lehman

*Attest:*

BRUCE LEHMAN

*Attesting Officer*

*Commissioner of Patents and Trademarks*